United States Patent [19]

Eggert, Jr.

[11] 4,044,689

[45] Aug. 30, 1977

[54] RESILIENTLY RAILWAY TRUCK SUSPENSION

[75] Inventor: Walter S. Eggert, Jr., Huntingdon Valley, Pa.

[73] Assignee: The Budd Company, Troy, Mich.

[21] Appl. No.: 624,368

[22] Filed: Oct. 21, 1975

[51] Int. Cl.[2] ..... B61F 5/30; B61F 5/38; B61F 5/52; B61F 15/12

[52] U.S. Cl. ..... 105/221 R; 105/224.1

[58] Field of Search ..... 105/182 R, 218, 221, 105/224 R, 224.1, 221 R

[56] References Cited

U.S. PATENT DOCUMENTS

| | | | |
|---|---|---|---|
| 1,825,530 | 9/1931 | Latshaw | 105/221 R |
| 2,197,727 | 4/1940 | Ledwinka | 105/224.1 X |
| 2,908,230 | 10/1959 | Dean | 105/182 R |
| 3,621,792 | 11/1971 | Lich | 105/224.1 |
| 3,720,175 | 3/1973 | Russell-French | 105/182 R X |
| 3,826,202 | 7/1974 | Russell-French | 105/182 R |

FOREIGN PATENT DOCUMENTS

| | | | |
|---|---|---|---|
| 622,205 | 11/1935 | Germany | 105/224.1 |

*Primary Examiner*—Robert J. Spar
*Assistant Examiner*—Howard Beltran

[57] ABSTRACT

Axle journal bearing mounting for railway truck having travel weave taken in elastomeric mounting bushing or sleeve elements surrounding the roller bearing assembly in which the outer bearing ring element, elastomeric bushing component and clamping means are formed to provide relatively free vertical weaving movement and relatively restricted lateral or horizontal weaving movement; also resiliently restricting axial movement while providing good characteristics for vibration and noise isolation and providing easy, convenient and accurate assembly with desired compression of the elastomeric material without requiring accessory equipment.

2 Claims, 3 Drawing Figures

Fig-2
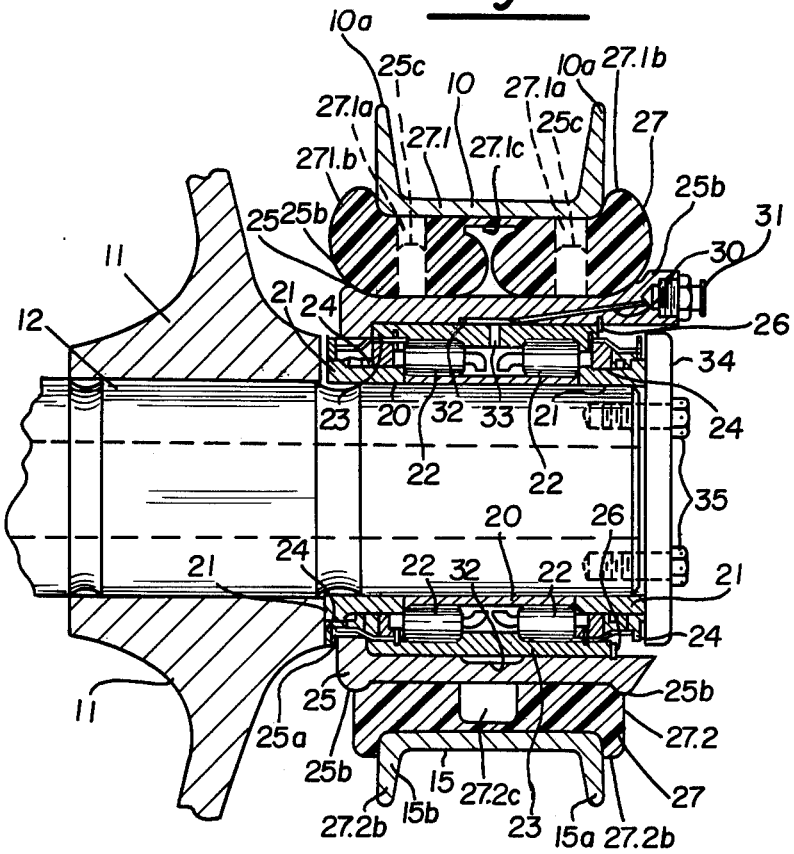
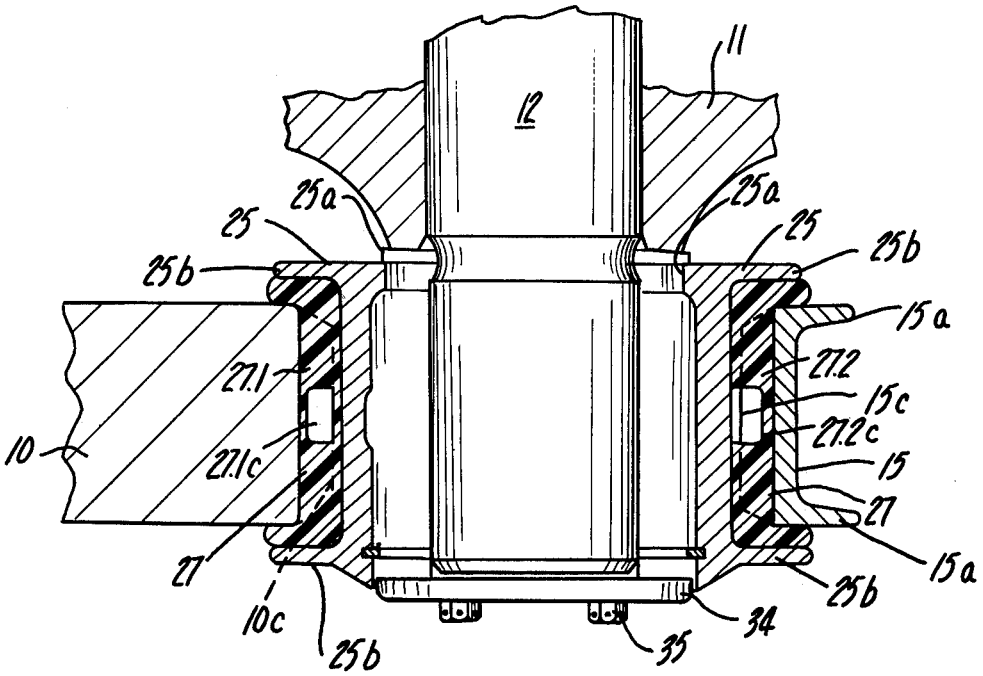
Fig-3

RESILIENTLY RAILWAY TRUCK SUSPENSION

BACKGROUND INFORMATION

U.S. Pat. No. 3,826,202, July 10, 1974, shows a railway vehicle truck of the type which has become known as the "Pioneer" truck which was disclosed in U.S. Pat. NO. 2,908,230, Oct 13, 1959, these trucks having considerable permissible frame weave through elastomeric bearing bushings or sleeves around the bearing assembly. These elastomeric bearing bushings formed noise and vibration barriers between the wheel-axle units and the truck frame and car body while maintaining the truck frame position on the axles. However, the elastomeric bushings did not provide as free vertical weaving movement as might be desired.

Full solid elastomeric bushings or sleeves, such as were used in earlier constructions has a very high spring rate, that is load in pounds to deflection inches, in the range of about 200,000 to 500,000, so had little effect as spring supports, serving mainly to reduce the transmission of higher frequency vibrations and noises from the wheels to the truck frame and vehicle body while permitting truck frame weave. Such solid elastomeric bushings or sleeves acted more like a confined liquid than a real spring.

There have been proposals for modifying the elastomeric components to provide better spring action but requiring auxiliary metallic means for limiting extreme axial movement and further auxiliary means for cushioning lesser axial movements.

SYNOPSIS OF INVENTION

The present invention provides a construction which has improved vibration and noise isolating characteristics; has improved vertical weave characteristics but with retained restriction of horizontal weave or tram; has cushioned resilient restraint of axial movement; and which is easy, convenient and accurate in assembly without requiring auxiliary instrumentalities.

DRAWINGS

The objects of the invention, as well as various features of novelty and advantages, will be apparent from the following description of an exemplary embodiment shown in the accompanying drawings, in which:

FIG. 2 is a vertical section taken about on the line 2—2 of FIG. 1;

FIG. 3 is a horizontal section taken about on the line 3—3 of FIG. 1.

SPECIFIC EMBODIMENT

Figure 1:
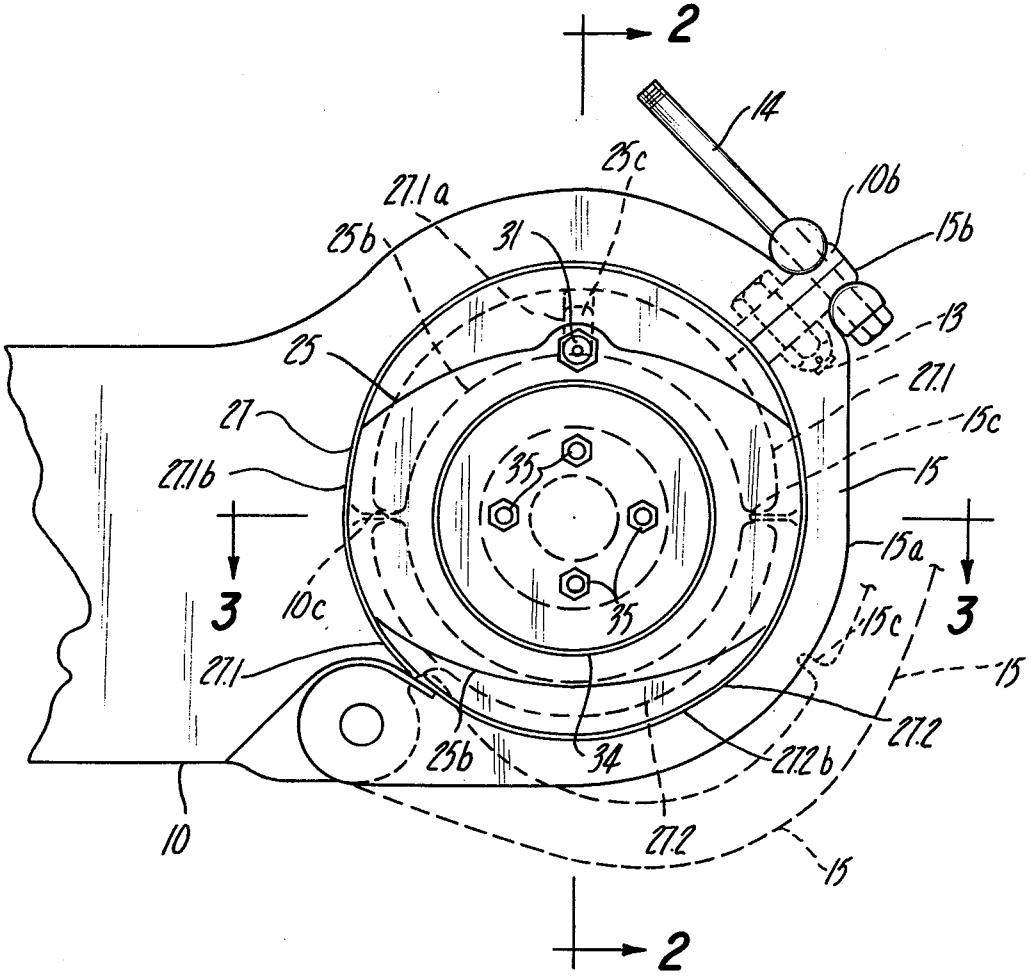
FIG. 1 is a side elevation of an axle bearing assembly.

A truck side frame member 10 at each end has a connection with a wheel-axle unit comprising a wheel 11 and an axle 12. The upper part of the side frame near the end has an arcuate inner concavity adapted to receive a bearing assembly and also has outer arcuate strengthening ribs 10*a.* At each extreme end it has an apertured flange projection 10*b* adapted to receive connecting means, such as bolts 13 and pull-up clamping rods 14.

A lower arcuate clamping ring member 15, having arcuate strengthening ribs 15*a,* is hinged to the side frame member 10 by a hinge pin 16 at one end and at the outer end has an apertured flange projection 15*b* to receive the connecting means 13, 14.

A roller bearing assembly of known type if provided around the journal of axle 12, here comprising an inner race ring 20 made fast on the journal, end race retainers 21, roller bearings 22, an outer race ring 23 and outer race ring retainers 24. Since the bearing assembly is a common type it need not be describedin detail.

Over the outer bearing race 23 there is secured an inner retaining ring 25 for holding elastomeric bushing means, the retaining means comprising an inner annular flange 25*a* on the inside edge and a plurality of retaining pins 26 at the outer edge.

The shape of the ring 25 is to be particularly noted since it is important in the functioning of the resilient elastomeric joint connection. It has outer radial circumferential retaining flanges 25*b* for confining the sides of elastomeric bushing means generally denoted by the numeral 27. The elastomeric bushing means comprises an upper segment 27.1 and a lower segment 27.2, the segments meeting about at a medial horizontal plane. The upper segment 27.1 is held in position by pins 25*c* carried by the retaining ring 25 and entering holes 27.1*a* in the elastomeric segment 27.1. Also a positioning lug 10*c* is provided on the interior of the arcuate concavity of the side frame member 10 for retaining one end of the segment 27.1, the segment having an end recess embracing both a side and the ends of the lug. Prior to final assembly the other end portion of the elastomeric segment 27.1 extends past the clamping ring joint line at 10*b,* 15*b,* lying on the outer surface of the inner bushing retaining ring 25, and at the very end has an end recess for embracing the side and ends of a retaining lug 15*c* of the lower outer clamping ring member 15. The elastomeric segment 27.2 has end recesses for embracing the side and ends of the lugs 10*c* and 15*c.*

It is to be noted that the elastomeric bushing segments 27.1, 27.2 are wider axially than the side frame 10 and the clamping ring member 15 and have arcuate radial flanges 27.1*b* and 27.2*b* which embrace the side of the ring-forming portions of 10 and 15. The flanges 25*b* of the inner retaining ring 25 are spaced apart by a sufficient distance to embrace the outer sides of the elastomeric bushing sugments 27.1, 27.2 so that the circumferential radial flanges 27.1*b,* 27.2*b* are secured between the inner sides of the flanges 25*b* and the outer sides of the side frame member 10 and the ring clamping member 15.

The segments 27.1, 27.2 are provided with inner deep circumferential grooves or channels 27.1*c,* 27.2*c* to provide for flow of elastomeric material when squeezed by clamping in final assembly. This condition is indicated at the top of FIG. 2.

The flanges 25*b* of the inner retaining ring 25 are radially wider at the sides, as shown in FIG. 3, and narrower radially at the top and bottom, as shown in FIG. 2. This allows more freedom of movement in a vertical plane and less freedom in a horizontal plane in tram.

The confinement of the radial flanges of the bushing segments provides resilient retention between parts and helps to minimize the transmission of noise and vibrations from the wheels to the truck frame and car body. It avoids the need to provide auxiliary metal-to-metal stop means for extreme axial movement or auxiliary resilient shock-absorbing means for lesser axial excursions.

The elastomeric bushing means, besides being less confined on the sides in a vertical plane than in a horizontal plane, is also thicker in a vertical plane, at least in the upper segment, than in a horizontal plane.

A lubricant duct 30, with a cap 31, leads to an annular channel 32 in the ring 25. The outer race ring 23 has one or more lubricant holes 33.

A cap plate 35, secured to the end of the axle journal as by set screws 36, retains the whole assembly in position.

In making the assembly, the elastomeric segment 27.1 is secured in the arcuate concavity of the side frame member 10, the inner end engaging the lug 10*c* and the segment being held in place by its side flanges embracing the sides of member 10. The lower segment 27.2 is secured in the hinged lower clamping ring member 15 with one end engaging lug 15*c* and its flanges embracing the sides of the ring member.

With the hinged lower ring clamping member in a fully open position, with the clamping means 13, 14 removed, the truck frame is brought down on the journal, carrying the bearing assembly and the inner ring 25, the pins 25*c* entering the holes 27.1*a* of the upper segment to maintain proper positional relationship, after which the hinged ring member 15 is brought up and then drawn up by the screw rods 14 until final clamped position is attained. The lugs 10*c*, 15*c* maintain the elastomeric segments in proper position during the clamping operations. When final position is attained the bolts 13 are connected. The clamping rods 14 may then be removed if desired.

The lesser confinement of the elastomeric bushing at the top and bottom and its greater confinement on the sides and also the greater thickness of the elastomeric material at the top (and bottom, if desired) and the lesser thickness on the sides provides relatively free vertical weave and more restricted weave in a horizontal plane or tram.

The confinement of the elastomeric radial side flanges by the metallic side flanges of the inner ring 25 and the sides of members 10 and 15 provides for limited axial movement but does not permit excessive axial movement, which can be especially helpful in case of a failure of the elastomeric material.

The construction disclosed provides an arrangement in which the resilient material can be compressed to the desired degree to maintain the journals in proper operating position and have the desired compression in the elastomeric material by the use only of the assembly mechanism itself without having to pre-compress the elastomeric material and possibly make a pre-assembly of it. FIG. 1 shows in chain lines what the position of the lower hinged ring clamping member may be at the beginning of clamping operations.

While one embodiment of the invention has been disclosed for purposes of illustration, it is to be understood that there may be various embodiments and modifications within the general scope of the invention.

I claim:

1. A railway truck journal bearing mount comprising, in combination, a bearing assembly on an axle journal, elastomeric bushing means surrounding said bearing assembly, an inner retaining ring having elliptical end flanges with the major axis horizontal and dimensioned to embrace the ends of said bushing means, an outer retaining ring means for clamping said bushing means on said inner retaining ring, said bushing means having radial circumferential end flanges embraced within the flanges of the inner retaining ring, the elastomeric bushing means at the ends being more completely embraced at the sides than at the top and bottom, the flanges of the bushing means embracing the sides of the clamping ring means, the bushing means being thicker at the top than elsewhere, tapering toward the sides, the bushing means being thinner at the middle circumferentially than at the sides, the bushing means being divided into upper and lower segments meeting on a horizontal axial plane, said clamping ring means being divided into upper and lower parts along an inclined axial plane, the lower clamping ring part being hinged to the upper clamping ring part and being connected at the outer end to the upper clamping ring part at an elevation above the horizontal axial plane, said inner retaining ring having radial pins at the top projecting into holes in the upper bushing segment, said upper clamping ring part having an interior lug embraced on the sides and ends by concavities in the adjacent ends of the bushing segments, and said lower clamping ring part having an interior lug embraced on the sides and ends by concavities in adjacent ends of the bushing segments.

2. A railway truck journal bearing mount as set forth in claim 1, in which elongated means are provided for drawing the clamp ring parts together, and bolts for securing the parts together in final assembly.

* * * * *